US011511904B2

(12) United States Patent
Saito et al.

(10) Patent No.: US 11,511,904 B2
(45) Date of Patent: Nov. 29, 2022

(54) STICKING APPARATUS

(71) Applicant: KITAGAWA INDUSTRIES CO., LTD., Inazawa (JP)

(72) Inventors: Masahiro Saito, Kasugai (JP); Naohiro Tachi, Kasugai (JP); Satoshi Deguchi, Kasugai (JP); Sakae Ushiwata, Kasugai (JP); Masaru Yagi, Kasugai (JP)

(73) Assignee: KITAGAWA INDUSTRIES CO., LTD., Inazawa (JP)

( * ) Notice: Subject to any disclaimer, the term of this patent is extended or adjusted under 35 U.S.C. 154(b) by 0 days.

(21) Appl. No.: 17/600,755

(22) PCT Filed: Apr. 13, 2020

(86) PCT No.: PCT/JP2020/016334
§ 371 (c)(1),
(2) Date: Oct. 1, 2021

(87) PCT Pub. No.: WO2020/213573
PCT Pub. Date: Oct. 22, 2020

(65) Prior Publication Data

US 2022/0194648 A1 Jun. 23, 2022

(30) Foreign Application Priority Data

Apr. 16, 2019 (JP) ..... JP2019-077891

(51) Int. Cl.
*B65C 9/36* (2006.01)
*B65C 9/18* (2006.01)
*B65C 9/42* (2006.01)

(52) U.S. Cl.
CPC ..... *B65C 9/1869* (2013.01); *B65C 9/36* (2013.01); *B65C 9/42* (2013.01)

(58) Field of Classification Search
CPC ..... B65C 9/42; B65C 9/1869
See application file for complete search history.

(56) References Cited

U.S. PATENT DOCUMENTS 4,294,644 A * 10/1981 Anderson ..... B65C 9/1869 156/361
4,427,484 A * 1/1984 Cameron, Jr. ..... B65C 9/42 156/391

(Continued)

FOREIGN PATENT DOCUMENTS

| | | | |
|---|---|---|---|
| CN | 1998036 | A | 7/2007 |
| JP | 2001315732 | A | 11/2001 |
| JP | 2006264723 | A | 10/2006 |
| JP | 2013133168 | A | 7/2013 |
| JP | 5292209 | B2 | 9/2013 |

OTHER PUBLICATIONS

International Preliminary Report On Patentability of International Application No. PCT/JP2020/016334, dated Sep. 28, 2021, 8 pages (Includes English Translation).

(Continued)

*Primary Examiner* — Philip C Tucker
*Assistant Examiner* — John Blades
(74) *Attorney, Agent, or Firm* — Grossman, Tucker, Perreault & Pfleger PLLC; Steven J. Grossman

(57) ABSTRACT

To provide a sticking apparatus capable of suppressing turning-up of an end of a sticking body. A sticking apparatus extrudes a sticking body from a tip in a protruding direction of a head member while moving the tip in a protruding direction of the head member along a target range, and sticks the sticking body to the target range. Extrusion speed of the sticking body becomes smaller than movement speed of the head member from a start of sticking of the sticking body with respect to the target range to a first time point, extrusion speed of the sticking body becomes larger than movement speed of the head member from the first time point to a second time point, and extrusion speed of the sticking body becomes smaller than movement speed of the head member from the second time point to sticking completion of the sticking body with respect to the target range.

5 Claims, 9 Drawing Sheets

(56) References Cited

U.S. PATENT DOCUMENTS

| | | | | |
|---|---|---|---|---|
| 5,188,696 | A * | 2/1993 | Good, Jr. | B65C 3/16 156/542 |
| 5,565,055 | A * | 10/1996 | Croci | B65C 3/16 156/240 |
| 5,938,890 | A | 8/1999 | Schlinkmann et al. | |
| 6,563,280 | B2 * | 5/2003 | Firehammer | B65C 9/42 318/560 |
| 2006/0289106 | A1 * | 12/2006 | Thiel | B65C 9/42 156/64 |
| 2009/0266470 | A1 * | 10/2009 | Biernat | B65C 9/1873 156/64 |
| 2011/0189477 | A1 * | 8/2011 | Miracle | B32B 7/06 428/347 |
| 2016/0236805 | A1 * | 8/2016 | Skopek | B65C 9/42 |
| 2017/0320609 | A1 * | 11/2017 | Pfeffer | B65C 9/1865 |

OTHER PUBLICATIONS

International Search Report of International Application No. PCT/JP2020/016334, dated Jun. 16, 2020, 5 pages (Includes English Translation).

Written Opinion of the International Searching Authority of International Application No. PCT/JP2020/016334, dated Jun. 16, 2020, 6 pages (Includes English Translation).

Office Action issued in corresponding Chinese Patent Application No. 202080027858.0 and its machine-generated English translation, dated Aug. 17, 2022.

* cited by examiner

STICKING APPARATUS

RELATED APPLICATIONS

This application is a National Phase Application of International PCT Application No. PCT/JP2020/016334 filed Apr. 13, 2020, which claims priority to Japanese Application No. JP2019-077891 filed Apr. 16, 2019, both of which are fully incorporated herein by reference.

TECHNICAL FIELD

The present disclosure relates to a sticking apparatus.

BACKGROUND ART

There is a known sheet sticking apparatus configured to stick an adhesive sheet having a planar shape to an adherend (e.g., see Patent Document 1).

CITATION LIST

Patent Literature

Patent Document 1: JP 5292209 B

SUMMARY OF INVENTION

Technical Problem

The present inventors have developed an apparatus of sticking, to an adherend, a sticking body having a planar shape and including an elastomer material as a base material. However, immediately after the sticking body is stuck to the adherend, it seems that proper sticking of the sticking body can be made, but with a lapse of time, an end of the sticking body may be turned up slightly, and there has been room for improvement in this respect.

An aspect of the present disclosure desirably provides a sticking apparatus capable of suppressing turning-up of an end of a sticking body.

Solution to Problem

The sticking apparatus according to an aspect of the present disclosure is a sticking apparatus configured to stick, to a target range set on an adherend, a sticking body having a planar shape and including at least one surface having adhesiveness. The sticking apparatus includes an extrusion mechanism, a support, a transport mechanism, and a control unit. The extrusion mechanism includes a head member that includes a guide surface and that protrudes. and the extrusion mechanism is configured to extrude, from a tip in a protruding direction of the head member, the sticking body fed along the guide surface to the tip side in a protruding direction of the head member. The support is configured to support the adherend. The transport mechanism is configured to enable relative positions of the extrusion mechanism and the support to be changed by moving at least one of the extrusion mechanism and the support. The control unit controls the extrusion mechanism and the transport mechanism such that the sticking body is extruded from the tip in a protruding direction of the head member by the extrusion mechanism while the tip in a protruding direction of the head member is moved along the target range by the transport mechanism, and such that the sticking body is stuck to the target range. Additionally, the control unit is configured to control the extrusion mechanism and the transport mechanism such that extrusion speed of the sticking body becomes smaller than movement speed of the head member during a period from a start of sticking of the sticking body with respect to the target range to a first time point, and extrusion speed of the sticking body becomes larger than movement speed of the head member during a period from the first time point to a second time point, and such that extrusion speed of the sticking body becomes smaller than movement speed of the head member during. a period from the second time point to sticking completion of the sticking body with respect to the target range.

According to the sticking apparatus thus configured, the extrusion mechanism and the transport mechanism are controlled by the control unit, and the extrusion mechanism and the transport mechanism operate such that extrusion speed of the sticking body becomes smaller than the movement speed of the head member during a period from when the sticking body starts sticking with respect to the target range to the first time point, and subsequently operate such that extrusion speed of the sticking body becomes larger than the movement speed of the head member during a period from the first time point to the second time point, and subsequently operate such that extrusion speed of the sticking body becomes smaller than movement speed of the head member during a period from the second time point to the sticking completion of the sticking body with respect to the target range. As a result, in a range where the sticking body is stuck during a period from the start of sticking to the first time point, and in a range where the sticking body is stuck during a period from the second time point to the sticking completion of the sticking body with respect to the target range, tensile stress is generated inside of the sticking body, and the sticking body is stuck in a tension state, and thus it is possible to suppress peeling of the sticking body from the adherend due to generation of slack in the sticking body, as compared with the case where the sticking body is in a non-tension state.

On the other hand, in a range where the sticking body is stuck during the first time point to the second time point, compressive stress is generated inside of the sticking body. Thus, unlike the case where tensile stress is generated entirely inside of the sticking body, it is possible to suppress turning-up of an end of the sticking body. That is, in a case where tensile stress is generated entirely inside of the sticking body, while the sticking body is restrained by adherence of the sticking body to the adherend near or at an interface with the adherend, the sticking body is not restrained in a side opposite to the adherend. Thus, shearing stress acting in opposite directions in a front side and a back side is generated in the sticking body, and an end of the sticking body is easily turned up. In contrast, as long as compressive stress is generated inside of the sticking body in the range where the sticking body is stuck during a period from the first time point to the second time point, it is possible to suppress pulling from both ends in all the sticking body even when tensile stress is generated in portions located in both sides of the sticking body, and it is possible to suppress turning-up of an end of the sticking body even when time has elapsed after sticking of the sticking body.

Note that the sticking apparatus of the present disclosure may further include the following configurations.

(A) For example, a pressing mechanism configured to press the sticking body stuck to the target range may further be provided. In this case, it is possible to enhance an effect of suppressing turning-up of an end of the sticking body by pressing the sticking body with the pressing mechanism.

(B) For example, the extrusion mechanism may include a carrier tape, a first reel, a second reel, and a tape drive portion. In the carrier tape, a plurality of the sticking bodies are stuck and arranged in a line, and the carrier tape is peeled off from the plurality of sticking bodies when the plurality of sticking bodies are stuck with respect to the adherend. The carrier tape is wound around. the first reel, and the first reel is configured to unwind the carrier tape when the extrusion mechanism is operated. The second reel is configured to wind the carrier tape when the extrusion mechanism is operated. The tape drive portion sandwiches the carrier tape between a plurality of rollers in the middle of a movement path of the carrier tape from the first reel to the second reel, and feeds the carrier tape from an upstream side to a downstream side in a movement direction when at least one of the plurality of rollers is rotationally driven. The carrier tape is configured to arrive along the guide surface at the tip in a protruding direction of the head member and then move in a folding-back direction in which the carrier tape is folded back with the tip in a protruding direction of the head member as a vertex, when the carrier tape is fed from the upstream side to the downstream side in the movement direction by the tape drive portion, and the carrier tape is configured to feed the plurality of sticking bodies to the tip side in a protruding direction of the head member by a portion that moves along the guide surface to the tip in a protruding direction of the head member, and is configured to be peeled off from the plurality of sticking bodies when the carrier tape moves in the folding-back direction.

(C) For example, assuming that a direction orthogonal to a protruding direction of the head member and parallel to the guide surface is a width direction of the head member, a first convex and a second convex may be provided respectively in both sides in the width direction at the tip in a protruding direction of the head member, and the carrier tape may be configured to be folded back with the tip in a protruding direction of the head member as a vertex, in a range between the first convex and the second convex. In this case, it is possible to suppress a shift in the width direction of the carrier tape at the tip in a protruding direction of the head member.

(D) For example, the transport mechanism may include an orthogonal robot that enables relative positions of the extrusion mechanism and the support to be changed by moving the extrusion mechanism in an x-axis direction and a z-axis direction. In this case, the relative positions of the extrusion mechanism and the support can be changed to desired positions by moving the extrusion mechanism in the x-axis direction and the z-axis direction without moving the support.

REFERENCE SIGNS LIST

1 Sticking apparatus, 2 Base, 3 Extrusion mechanism, 5 Support, 7 Transport mechanism, 9 Pressing mechanism, 10 Control unit, 11 Base portion, 13 Transport roller, 15 Tape drive portion, 17 Photoelectric sensor, 19 Head member, 19A Guide surface, 21 First reel, 22 Second reel, 25 Sticking body, 27 Carrier tape, 31 First convex, 32 Second convex, 40 Column, 41 First rail, Second rail, 51 Rail portion, 53 Pressing body, 61 Adhesive layer, 62 Adhesion suppressing layer, 71 Adhesive region, 72 Adhesion suppressing region, 251 First surface, 252 Second surface.

DESCRIPTION OF EMBODIMENTS

Figure 1:
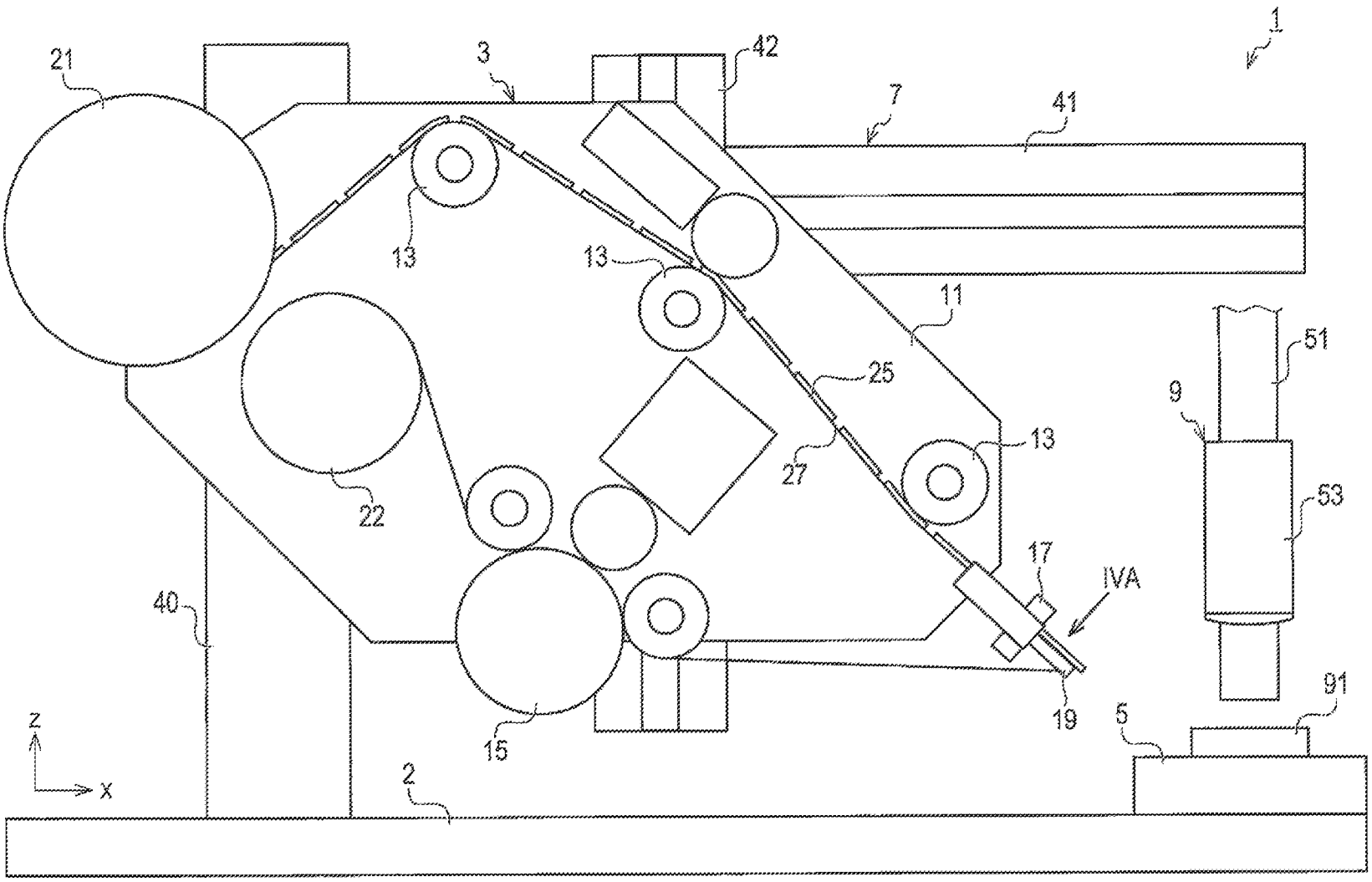
FIG. 1 is a front view schematically illustrating a structure of a sticking apparatus.
Figure 2:
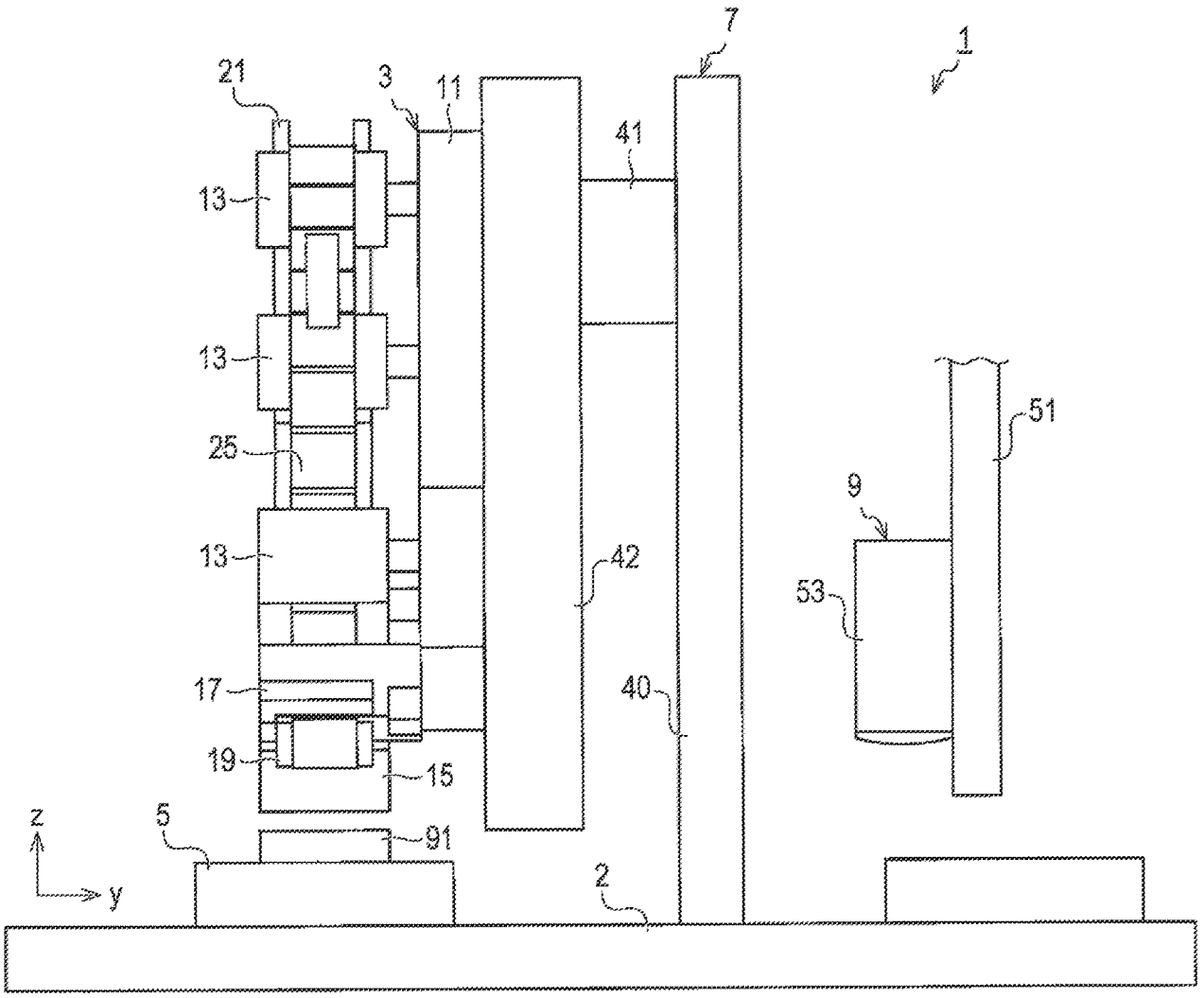
FIG. 2 is a right side view schematically illustrating the structure of the sticking apparatus.
Figure 3:
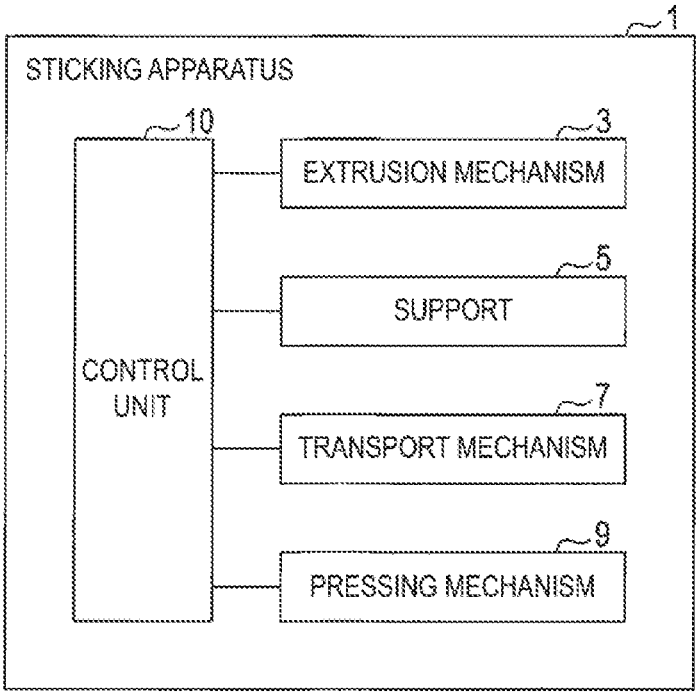
FIG. 3 is a block diagram illustrating a control system of the sticking apparatus.

Next, the sticking apparatus described above will be described with reference to exemplary embodiments. As illustrated in FIGS. 1 and 2, a sticking apparatus 1 includes a base 2, an extrusion mechanism 3, a support 5, a transport mechanism 7, and a pressing mechanism 9. Additionally, as illustrated in FIG. 3, the sticking apparatus 1 includes a control unit 10.

As illustrated in FIG. 1, the extrusion mechanism 3 includes a base portion 11, a transport roller 13, a tape drive portion 15, a photoelectric sensor 17, a head member 19, and the like. A first reel 21 and a second reel 22 are attached to the extrusion mechanism 3. A carrier tape 27 in which a plurality of sticking bodies 25 are stuck and arranged in a line is wound around the first reel 21. The first reel 21 is configured to unwind the carrier tape 27 when the extrusion mechanism 3 is operated. The carrier tape 27 pulled out of the first reel 21 is hung over each portion to pass through a movement path that leads via the transport roller 13, the head member 19, the tape drive portion 15, and the like to the second reel 22. The second reel 22 is configured to wind the carrier tape 27 when the extrusion mechanism 3 is operated.

The tape drive portion 15 is configured to sandwich the carrier tape 27 between a plurality of rollers in the middle of the movement path of the carrier tape 27 from the first reel 21 to the second reel 22. and is configured to feed the carrier tape 27 from an upstream side to a downstream side in a movement direction when at least one of the rollers is rotationally driven. The photoelectric sensor 17 is configured to detect a position of each of the sticking bodies 25 when the carrier tape 27 is fed from the upstream side to the downstream side in the movement direction.

In the case of the present embodiment, the carrier tape 27 includes a transparent film, and the sticking bodies 25 include an opaque material, and two sticking bodies 25 in adjacent positions are stuck to the carrier tape 27 with a gap between the two sticking bodies 25. Thus, when each of the sticking bodies 25 and each gap between the sticking bodies 25 pass in front of the photoelectric sensor 17, a start of the passage of the sticking body 25 (i.e., completion of the passage of the gap) and completion of the passage of the sticking body 25 (i.e., a start of the passage of the gap) can be detected based on a difference in transmittance of light (infrared light in the case of the present embodiment) obtained when the carrier tape 27 and each of the sticking bodies 25 are irradiated with the light.

Figure 4A:
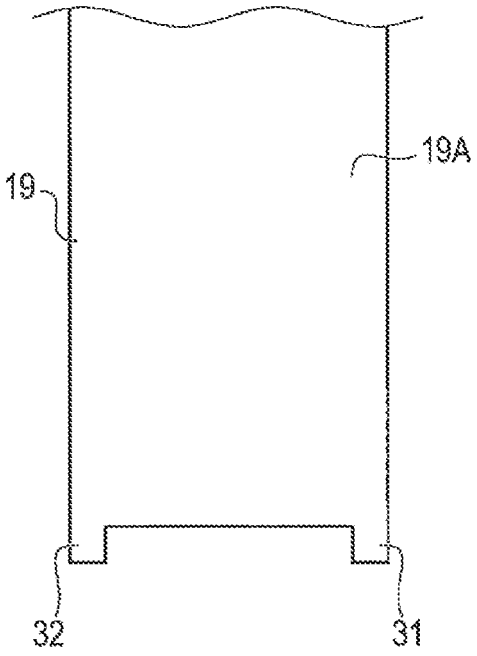
FIG. 4A is an arrow view of a head member viewed from an IVA direction illustrated in FIG. 1.
Figure 4B:
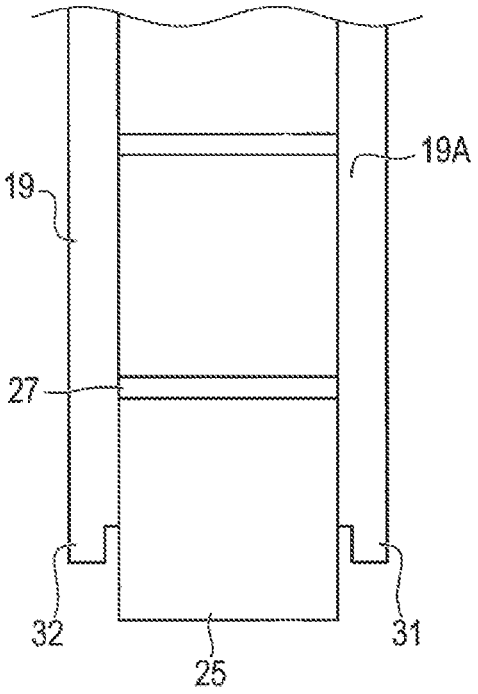
FIG. 4B is an arrow view of the head member, a carrier tape, and a sticking body viewed from the same direction as FIG. 4A.

The head member 19 includes a metal plate. As illustrated in FIGS. 4A and 4B, an upper surface side of the head member 19 is a guide surface 19A for guiding the carrier tape 27 to a tip side in a protruding direction of the head member 19. The carrier tape 27 arrives along the guide surface 19A at the tip in a protruding direction of the head member 19 and then moves in a folding-back direction in which the carrier tape 27 is folded back with the tip in a protruding direction of the head member 19 as a vertex. At this time, as illustrated in FIG. 4B, the carrier tape 27 feeds the sticking bodies 25 to the tip side in a protruding direction of the head member 19 by a portion that moves along the guide surface 19A to the tip in a protruding direction of the head member 19, and the carrier tape 27 is peeled off from the sticking bodies 25 when the carrier tape 27 moves in the folding-back direction described above. Accordingly, the sticking bodies 25 are extruded from the tip in a protruding direction of the head member 19.

Additionally, as viewed from a direction of arrow IVA illustrated in FIG. 1, the head member 19 has a shape including a first convex 31 and a second convex 32 respectively in both sides in a width direction at the tip in a protruding direction of the head member 19, as illustrated in the FIG. 4A. The carrier tape 27 moves to be folded back with the tip in a protruding direction of the head member 19 as a vertex, in a range between the first convex 31 and the second convex 32. Thus, as long as the first convex 31 and the second convex 32 are provided in the head member 19, it is possible to suppress a shift in the width direction of the carrier tape 27 at the tip in a protruding direction of the head member 19.

The support 5 is configured to be able to support an adherend 91. The support 5 is configured to be able to reciprocate in a direction parallel to a y-axis direction illustrated in FIG, 2. The transport mechanism 7 includes a column 40, a first rail 41, a second rail 42, and the like. The second rail 42 is configured to be able to reciprocate along the first rail 41 in a direction parallel to an x-axis direction illustrated in FIG. 1. The extrusion mechanism 3 is configured to be able to reciprocate along the second rail 42 in a direction parallel to a z-axis direction illustrated in FIGS. 1 and 2. That is, the transport mechanism 7 can move the extrusion mechanism 3 in a direction along a z-x plane. In the case of the present embodiment, the transport mechanism 7 includes an orthogonal robot that enables relative positions of the extrusion mechanism 3 and the support 5 to be changed by moving the extrusion mechanism 3 in the x-axis direction and the z-axis direction.

The pressing mechanism 9 includes a rail portion 51 and a pressing body 53. The pressing body 53 is configured to be able to reciprocate along the rail portion 51 in a direction parallel to the z-axis direction illustrated in FIGS. 1 and 2. When the pressing body 53 descends, each of the sticking bodies 25 can be pressed by a lower end portion of the pressing body 53.

Figure 5B:
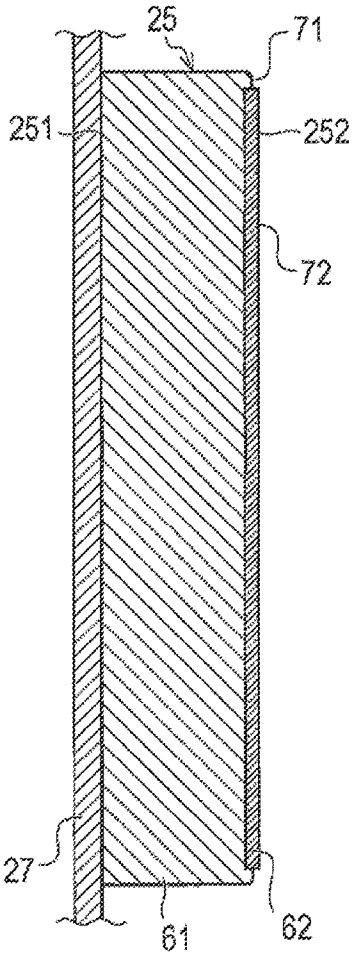
FIG. 5B is a cross-sectional view taken along line VB-VB in FIG. 5A.
Figure 5A:
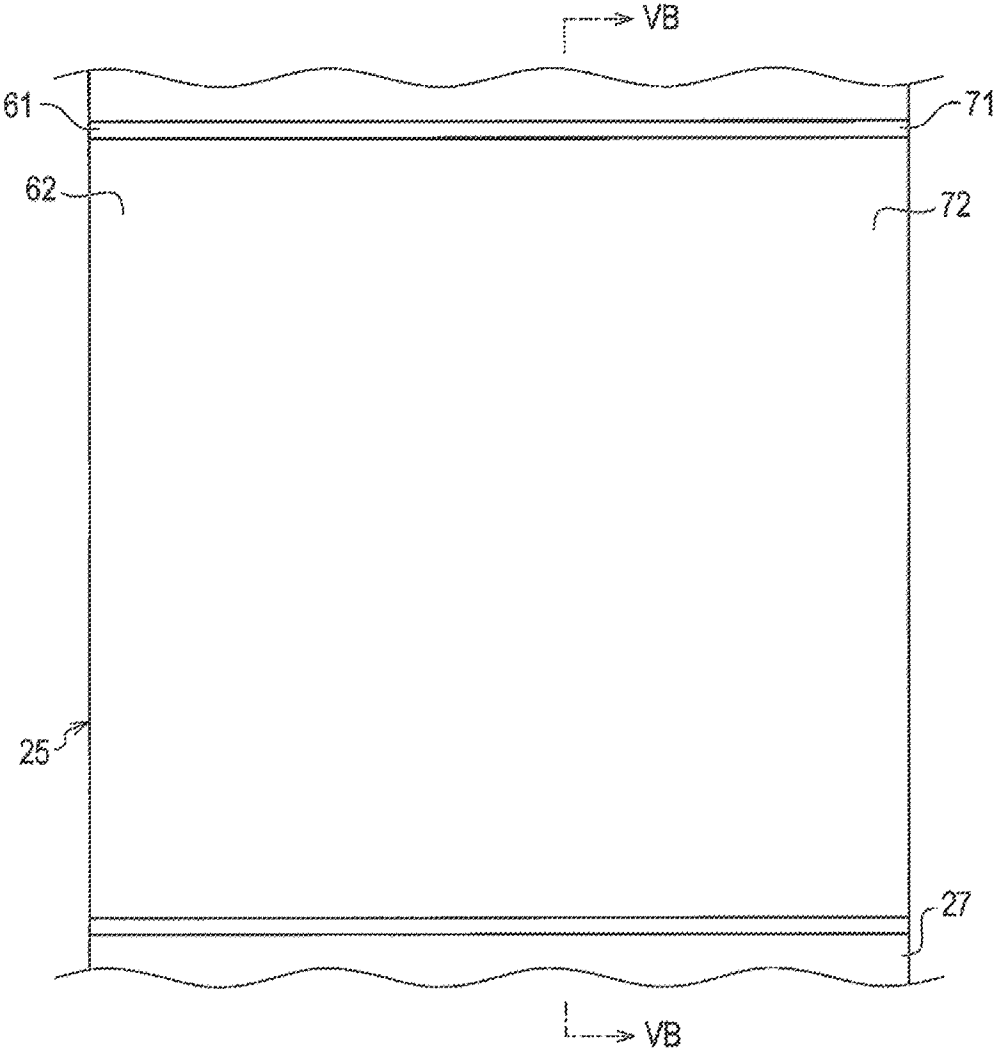
FIG. 5A is a plan view of a portion of the carrier tape and the sticking body.

As illustrated in FIGS. 5A and 5B, the sticking bodies 25 each have a planar shape. Among a first surface 251 and a second surface 252 of the sticking body 25, the first surface 251 is an adhesive surface that is stickable with respect to the adherend 91. The sticking body 25 includes a structure in which an adhesive layer 61 including an elastomer material having adhesiveness, and an adhesion suppressing layer 62 configured to suppress adhesiveness of the adhesive layer 61 are stacked.

In the case of the present embodiment, as the elastomer material constituting the adhesive layer 61, a thermally conductive elastomer obtained by compounding a thermally conductive filler and a plasticizer with an acrylic resin as a base material is used. More specifically, in the case of the present embodiment, the adhesive layer 61 includes a thermally conductive elastomer in which a polymer obtained by polymerizing a monomer containing acrylic acid ester is used as a base material, and magnesium hydroxide treated with a higher fatty acid is compounded as a thermally conductive filler in the base material, and in which other thermally conductive filler, a plasticizer, and the like are further compounded.

A compounding ratio of these raw material components can be adjusted arbitrarily, but as an example, for example, 100 to 160 parts by weight of magnesium hydroxide may be compounded and 250 to 330 parts by weight of other thermally conductive filler may be compounded with respect to 100 parts by weight of a polymer. Examples of the other thermally conductive filler include aluminum hydroxide, silicon carbide, boron nitride, and carbon materials such as graphite and a carbon nanotube. As the plasticizer, for example, trimellitic acid ester may be compounded by an amount of 6 parts by weight or more with respect to 100 parts by weight of a polymer. The adhesive layer 61 may be configured to have hardness of 10 or less as measured by Asker Durometer Type C (manufactured by Kobunshi Keiki Co., Ltd.). Additionally, the adhesive layer 61 may be configured to have thermal conductivity of 2 W/m·K or more.

In the case of the present embodiment, the adhesive layer 61 is configured to have a thickness of about 0.1 to 6.0 mm. Additionally, the adhesion suppressing layer 62 includes a polyester film having a thickness of 5 μm. However, the thicknesses of the adhesive layer 61 and the thickness of the adhesion suppressing layer 62 are merely representative examples, and are not limited to the specific dimensions exemplified. The polyester film constituting the adhesion suppressing layer 62 has flexibility to an extent that the polyester film is deformable together with the adhesive layer 61 into a shape that comes into close contact with a contact object when the contact object comes into contact with the second surface 252 of the sticking body 25.

In the second surface 252 of the sticking body 25, the adhesive layer 61 is configured to protrude to an outer peripheral side of the adhesion suppressing layer 62. Accordingly, the second surface 252 of the sticking body 25 is provided with an adhesive region 71 having adhesiveness and an adhesion suppressing region 72 where adhesiveness is suppressed. In the case of the present embodiment, the sticking body 25 is formed to be a square of 27 mm. The adhesive region 71 is formed to have a length of 27 mm and a width of 0.15 mm, and is provided in a position along each of two sides orthogonal to a longitudinal direction of the carrier tape 27 among four sides of the sticking body 25. Such an adhesive region 71 is provided, and accordingly, the second surface 252 of the sticking body 25 is configured to have weaker adhesiveness than adhesiveness of the first surface 251.

As described above, as illustrated in FIG. 6A, in the carrier tape 27, the plurality of sticking bodies 25 are stuck and arranged in a line, and the carrier tape 27 is wound around the first reel 21. In the case of the present embodiment, the sticking bodies 25 are stuck to the carrier tape 27 at an interval of 3 mm. The carrier tape 27 includes a polyester film having a total length of 62 m, a width of 27 mm, and a thickness of 0.05 mm. At each of both ends of the carrier tape 27, a region of I m where no sticking body 25 is stuck is provided. Therefore, regions where the sticking bodies 25 are stuck have a total length of 60 m. The first reel has an outer diameter of 435 mm.

Figure 6A:
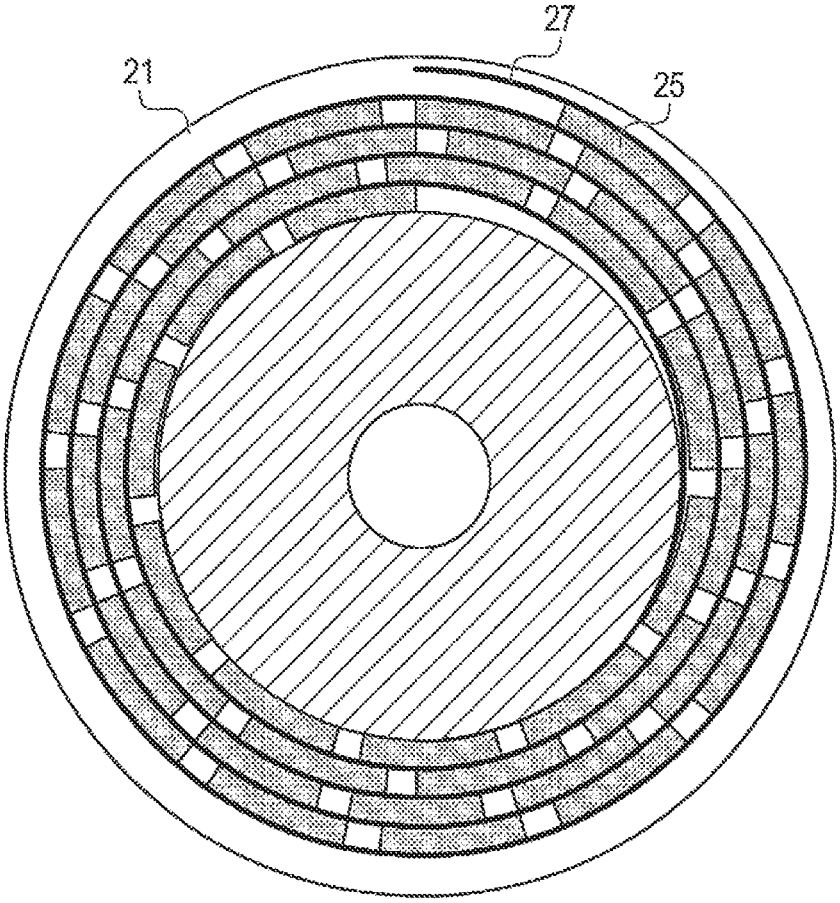
FIG. 6A is an explanatory view for explaining a structure of a plurality of the sticking bodies, the carrier tape, and a first reel.
Figure 6B:
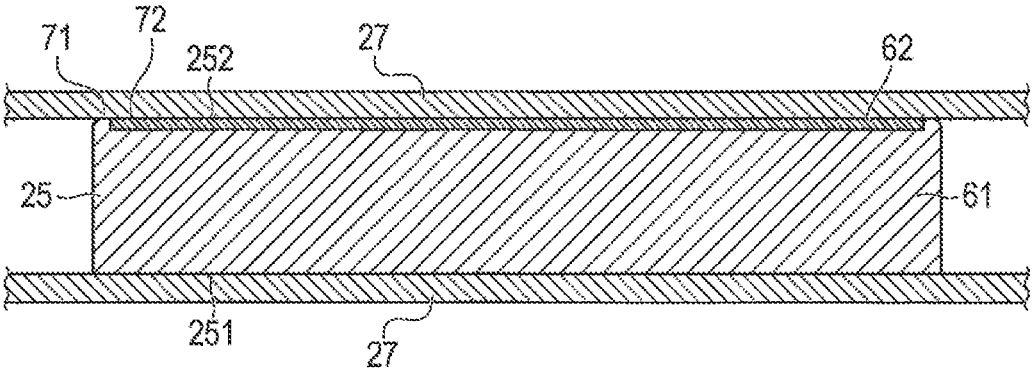
FIG. 6B is an explanatory view illustrating the sticking body sandwiched between the carrier tapes.

When the carrier tape 27 is wound around the first reel 21, as illustrated in FIGS. 6A and 6B, each of the sticking bodies 25 is sandwiched between the carrier tape 27 located in an inner peripheral side and the carrier tape 27 located in an outer peripheral side. At this time, when the adhesive region 71 as described above is provided in the second surface 252 of the sticking body 25, the second surface 252 of the sticking body 25 adheres to the carrier tape 27 located in the inner peripheral side by slight adhesive force. Thus, it is possible to suppress generation of slack in the carrier tape 27 wound around the first reel 21.

Moreover, the adhesion suppressing region 72 as described above is provided in the second surface 252, and thus, adhesive force of the second surface 252 becomes much weaker than adhesive force of the first surface 251 in which the adhesion suppressing region 72 is not provided. Thus, when the carrier tape 27 is unwound from the first reel 21, it is possible to suppress hindrance to the unwinding of the carrier tape 27 due to adhesive force of the second surface 252. Additionally, when the carrier tape 27 is unwound from the first reel 21, it is possible to suppress peeling of the carrier tape 27 located in the outer peripheral side from the sticking body 25 while the sticking body 25 remains adhering to the carrier tape 27 located in the inner peripheral side.

Figure 7A:
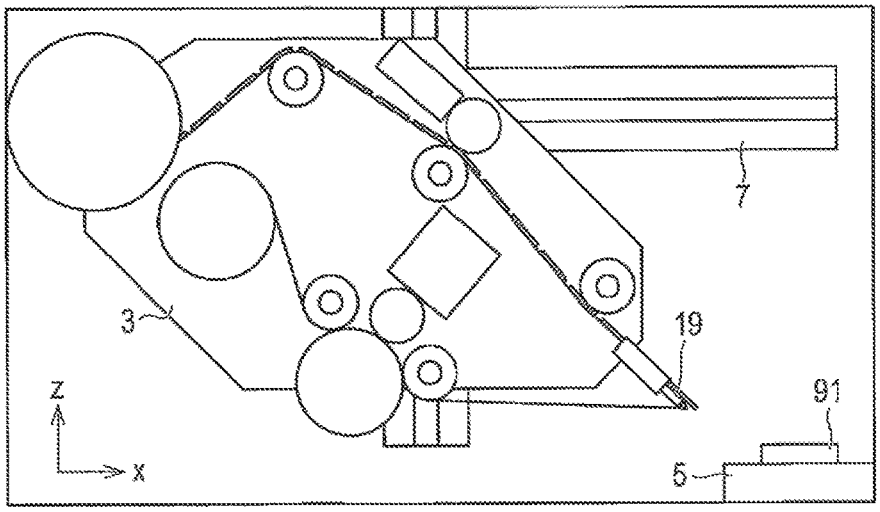
FIG. 7A is an explanatory view illustrating a state where an extrusion mechanism is located in a first position.
Figure 7B:
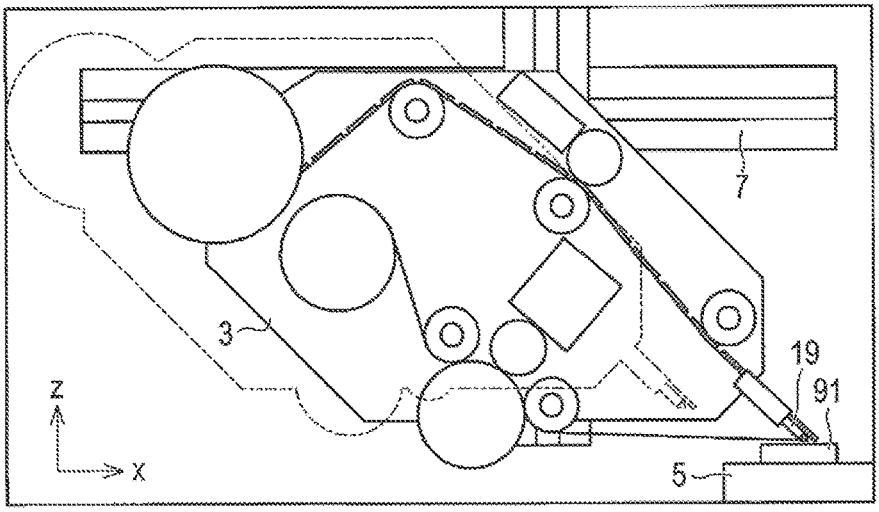
FIG. 7B is an explanatory view illustrating a state where the extrusion mechanism is located in a second position.
Figure 7C:
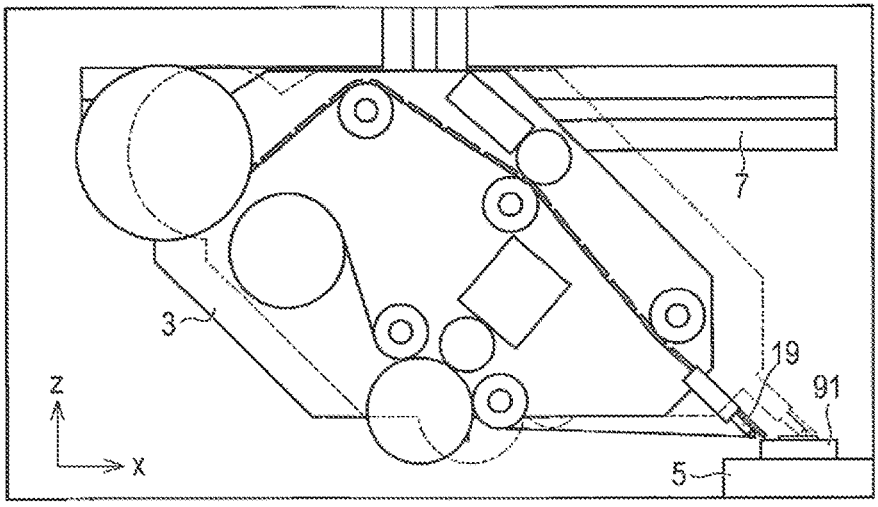
FIG. 7C is an explanatory view illustrating a state where the extrusion mechanism is located in a third position.

In the case of the present embodiment, the control unit 10 includes a PLC. PLC is an abbreviation for Programmable Logic Controller. The control unit 10 controls the operations of the extrusion mechanism 3, the support 5, the transport mechanism 7, and the pressing mechanism 9 described above. When the sticking body 25 is stuck to the adherend 91 supported by the support 5, the control unit 10 operates the transport mechanism 7 to move the extrusion mechanism 3 from a first position illustrated in FIG. 7A to a second position illustrated in FIG. 7B. Then, the extrusion mechanism 3 is moved from the second position illustrated in FIG, 7B to a third position illustrated in FIG. 7C, and accordingly, the tip in a protruding direction of the head member 19 is moved along a target range set on the adherend 91. During this movement from the second position to the third position, the control unit 10 operates the extrusion mechanism 3. Accordingly, the sticking body 25 is extruded from the tip in a protruding direction of the head member 19, and the sticking body 25 is stuck to the target range.

Figure 8A:
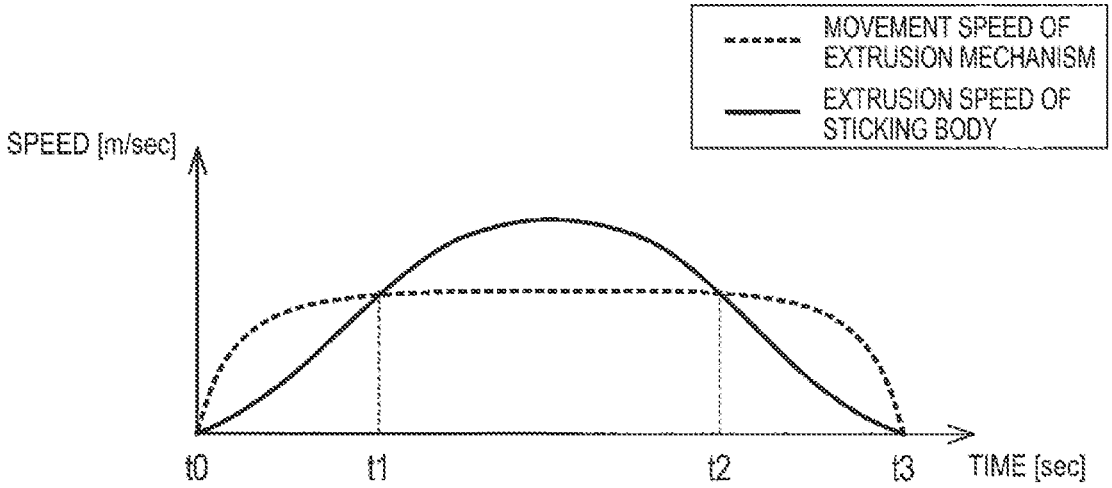
FIG. 8A is a graph showing relationship between movement speed of the extrusion mechanism and extrusion speed of the sticking body.

The control unit 10 controls operation speed of each of the extrusion mechanism 3 and the transport mechanism 7 to become speed shown in FIG. 8A. Accordingly, during a period from a start of sticking time point t0 of the sticking body 25 with respect to the target range to a first time point t1, extrusion speed of the sticking body 25 becomes smaller than movement speed of the head member 19. Additionally, during a period from the first time point t1 to a second time point t2, extrusion speed of the sticking body 25 becomes larger than movement speed of the head member 19. Further, during a period from the second time point t2 to a sticking completion time point t3 of the sticking body 25 with respect to the target range, extrusion speed of the sticking body 25 becomes smaller than movement speed of the head member 19.

Figure 8B:
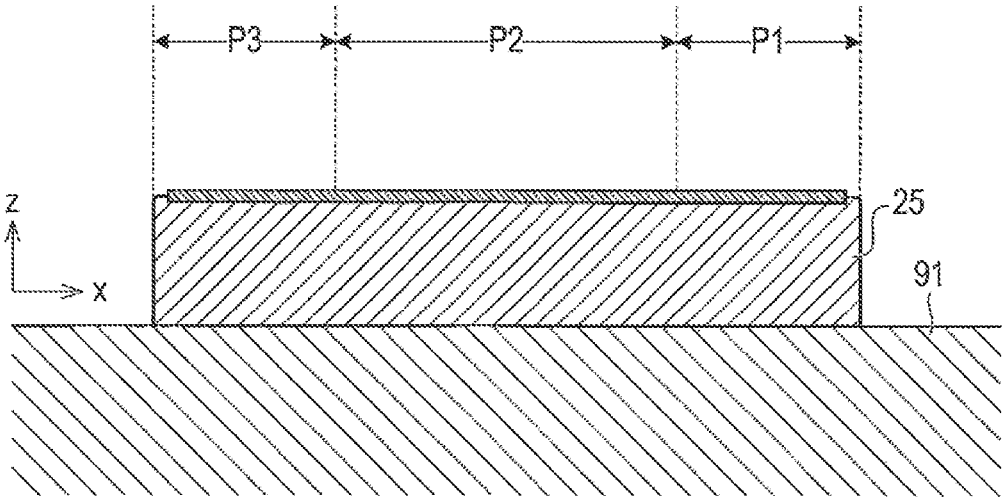
FIG. 8B is an explanatory view illustrating a range where tensile stress is generated and a range where compressive stress is generated, in the sticking body.

According to such control, as illustrated in FIG. 8B, in a range P1 where the sticking body 25 is stuck during a period from the start of sticking time point t0 to the first time point t1, the sticking body 25 stuck to the target range is stuck to the target range in a state where the sticking body 25 is slightly pulled, and the sticking body 25 becomes in a state where tensile stress is generated inside of the sticking body 25. Additionally, in a range P2 where the sticking body 25 is stuck during a period from the first time point t1 to the second time point t2, the sticking body 25 is stuck to the target range in a state where the sticking body 25 is slightly pressed, and the sticking body 25 becomes in a state where compressive stress is generated inside of the sticking body 25. Further, in a range P3 where the sticking body 25 is stuck during a period from the second time point t2 to the sticking completion time point t3 of the sticking body 25 with respect to the target range, the sticking body 25 is stuck to the target range in a state where the sticking body 25 is slightly pulled, and the sticking body 25 becomes in a state where tensile stress is generated inside of the sticking body 25.

Thus, in the range P1 and the range P3 illustrated in FIG. 8B, the sticking body 25 is stuck in a tension state, and thus, it is possible to suppress peeling of the sticking body 25 from the adherend 91 due to generation of slack in the sticking body 25, as compared with the case where the sticking body 25 is in a non-tension state. On the other hand, in the range P2. compressive stress is generated inside of the sticking body 25. Thus, unlike the case where tensile stress is generated entirely inside of the sticking body 25, it is possible to suppress turning-up of an end of the sticking body 25.

In a case where tensile stress is generated entirely inside of the sticking body 25, while the sticking body 25 is restrained by adherence of the sticking body 25 to the adherend 91 near or at an interface with the adherend 91, the sticking body 25 is not restrained in a side opposite to the adherend 91. Thus, shearing stress acting in opposite directions in a front side and a back side is generated in the sticking body 25, and an end of the sticking body 25 is easily turned up. In contrast, as long as compressive stress is generated inside of the sticking body 25 in the range P2 described above, it is possible to suppress pulling from both ends in all the sticking body 25 even when tensile stress is generated in portions located in both sides of the sticking body 25. Thus, even in a case where time has elapsed after sticking of the sticking body 25, it is possible to suppress turning-up of an end of the sticking body 25.

Figure 9A:
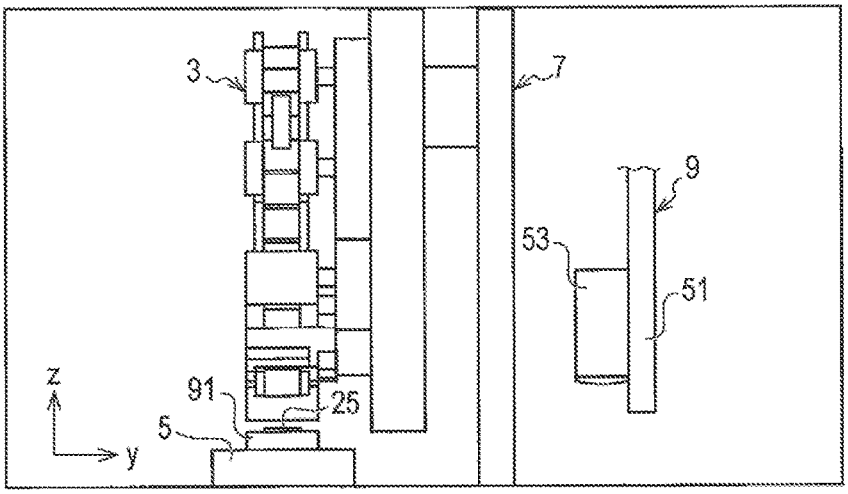
FIG. 9A is an explanatory view illustrating a state where a support is located in a position for sticking.
Figure 9B:
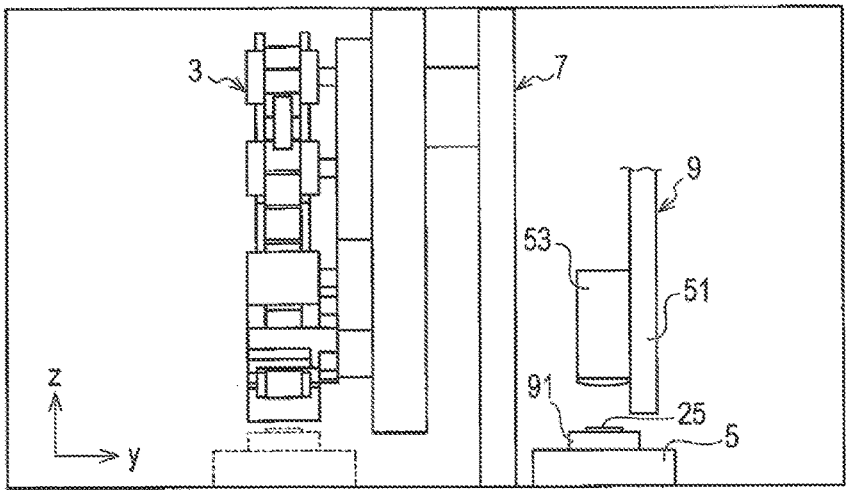
FIG. 9B is an explanatory view illustrating a. state where the support is located in a position for pressing, and a pressing body is located in an ascent position.
Figure 9C:
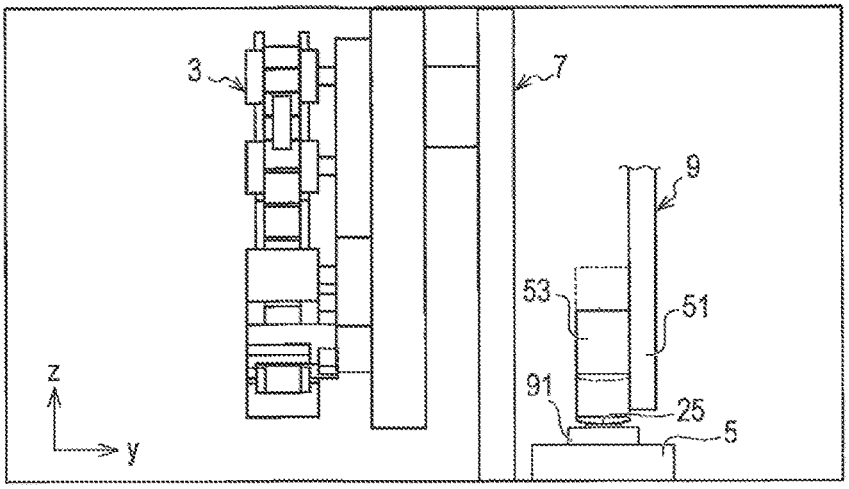
FIG. 9C is an explanatory view illustrating a state where the support is located in the position for pressing, and the pressing body is located in a descent position.

When the sticking body 25 is stuck to the target range, the control unit 10 moves the support 5 from a position for sticking illustrated in FIG. 9A to a position for pressing illustrated in FIG. 9B. Subsequently, the control unit 10 controls the pressing mechanism 9 to move the pressing body 53 from an ascent position illustrated in FIG. 9B to a descent position illustrated in FIG. 9C. Accordingly, pressing with respect to the sticking body 25 is performed with the pressing body 53, and it is possible to bring the sticking body 25 into close contact with the adherend 91.

According to the sticking apparatus 1 as described above, even in a case where time has elapsed after sticking of the sticking body 25, it is possible to suppress turning-up of an end of the sticking body 25.

While the sticking apparatus 1 is described above with reference to the exemplary embodiments, the embodiments described above are merely examples as an aspect of the present disclosure. That is, the present disclosure is not limited to the exemplary embodiments described above, and can be carried out in various forms without departing from the technical concept of the present disclosure.

For example, in the embodiments described above, the extrusion mechanism 3 is configured to be moved in the direction along the z-x plane by the transport mechanism 7. However, the extrusion mechanism 3 side may be fixed and the support 5 side may be moved such that the extrusion mechanism 3 and the support 5 are displaced to the same relative positions. Additionally, both the extrusion mechanism 3 side and the support 5 side may be moved. For example, the extrusion mechanism 3 side may be configured to be capable of reciprocating in parallel to the x-axis direction, and the support 5 side may be configured to be capable of reciprocating in parallel to the z-axis direction.

Additionally, in the embodiments described above, the width of the adhesive region 71 is 0.15 mm. However, the width of the adhesive region 71 may be narrower than 0.15 mm or may be wider than 0.15 mm. Additionally, in the embodiments described above, the adhesive region 71 is provided in the position along each of the two sides orthogonal to the longitudinal direction of the carrier tape 27 among the four sides of the sticking body 25. However, the position in which the adhesive region 71 is provided and the shape of the adhesive region 71 are not limited to the examples described above. For example, the adhesive region 71 may be provided in a position along each of the four sides of the sticking body 25 (that is, all the periphery of the adhesion suppressing layer 62). Additionally, the adhesive region 71 may be provided in a position along one side, or may be provided in a position along each of two sides different from the two sides in the examples described above, or may be provided in a position along each of three sides, among the four sides of the sticking body 25. Alternatively, a hole may be formed in the adhesion suppressing layer 62, and accordingly, a location corresponding to the hole may become an adhesive region.

Note that a plurality of functions that one constituent has in the embodiments described above may be realized by a plurality of constituents, or one function that one constituent has may be realized by a plurality of constituents. Additionally, a plurality of functions that a plurality of constituents have may be realized by one constituent, or one function realized by a plurality of constituents may be realized by one constituent. Additionally, a portion of the configurations of the embodiments described above may be omitted.

What is claimed is:

1. A sticking apparatus configured to stick, to a target range set on an adherend, a sticking body having a planar shape and including at least one surface having adhesiveness, the sticking apparatus comprising:

a reel-to-reel mechanism for feeding a backing strip carrying a peelable sticking body, including a head member that includes a guide surface and that protrudes, the reel-to-reel mechanism configured to provide, from a tip in a protruding direction of the head member, the sticking body fed along the guide surface to the tip;

a support structure having a surface configured to support the adherend;

a column and rail transport mechanism configured to enable relative positions of the reel-to-reel mechanism and the support to be changed by moving at least one of the reel-to-reel mechanism and the support surface; and a control unit configured to control the reel-to-reel mechanism and the transport mechanism such that the sticking body protrudes from the tip by the reel-to-reel mechanism while the tip is moved along the target range by the transport mechanism, and such that the sticking body is stuck to the target range, wherein the control unit is configured to control the reel-to-reel mechanism and the transport mechanism such that a speed of the sticking body in the reel-to-reel mechanism becomes smaller than movement speed of the head member during a period from a start of sticking of the sticking body with respect to the target range to a first time point, and the speed of the sticking body in the reel-to-reel mechanism becomes larger than movement speed of the head member during a period from the first time point to a second time point, and such that the speed of the sticking body becomes smaller than movement speed of the head member during a period from the second time point to sticking completion of the sticking body with respect to the target range.

2. The sticking apparatus according to claim 1, further comprising a pressing mechanism configured to press the sticking body stuck to the target range.

3. The sticking apparatus according to claim 1, wherein the reel-to-reel mechanism includes a carrier tape in which a plurality of the sticking bodies are stuck and arranged in a line, and which is peeled off from the plurality of sticking bodies when the plurality of sticking bodies are stuck with respect to the adherend, a first reel around which the carrier tape is wound, and which is configured to unwind the carrier tape when the reel-to-reel mechanism is operated, a second reel configured to wind the carrier tape when the reel-to-reel mechanism is operated, and a tape drive portion configured to sandwich the carrier tape between a plurality of rollers in the middle of a movement path of the carrier tape from the first reel to the second reel, and configured to feed the carrier tape from an upstream side to a downstream side in a movement direction when at least one of the plurality of rollers is rotationally driven, and the carrier tape is configured to arrive along the guide surface at the tip and then move in a folding-back direction in which the carrier tape is folded back with the tip as a vertex, when the carrier tape is fed from the upstream side to the downstream side in the movement direction by the tape drive portion, and the carrier tape is configured to feed the plurality of sticking bodies to the tip by a portion that moves along the guide surface to the tip, and is configured to be peeled off from the plurality of sticking bodies when the carrier tape moves in the folding-back direction.

4. The sticking apparatus according to claim 3, wherein that a direction orthogonal to a protruding direction of the head member and parallel to the guide surface is a width direction of the head member, a first convex and a second convex are provided respectively in both sides in the width direction at the tip, and the carrier tape is configured to be folded back with the tip as the vertex, in a range between the first convex and the second convex.

5. The sticking apparatus according to claim 1, wherein the transport mechanism includes an orthogonal robot that enables relative positions of the reel-to-reel mechanism and the support to be changed by moving the reel-to-reel mechanism in an x-axis direction and a z-axis direction.

* * * * *